US006984118B2

(12) United States Patent
Kuch et al.

(10) Patent No.: US 6,984,118 B2
(45) Date of Patent: Jan. 10, 2006

(54) METHOD AND APPARATUS FOR THE PRODUCTION OF TUBES FROM CONCRETE MIX

(75) Inventors: Helmut Kuch, Weimar (DE); Jorg-Henry Schwabe, Weimar (DE); Jurgen Martin, Jena (DE); Torsten Benzin, Tautenburg (DE)

(73) Assignee: Institut fur Fertigteiltechnik UND, Weimar (DE)

( * ) Notice: Subject to any disclaimer, the term of this patent is extended or adjusted under 35 U.S.C. 154(b) by 438 days.

(21) Appl. No.: 10/286,337

(22) Filed: Nov. 1, 2002

(65) Prior Publication Data

US 2003/0085490 A1 May 8, 2003

(30) Foreign Application Priority Data

Nov. 2, 2001 (EP) ..... 01126084

(51) Int. Cl.
*B28B 1/20* (2006.01)

(52) U.S. Cl. ..... 425/262; 425/426; 425/460; 264/312

(58) Field of Classification Search ..... 425/86, 425/426, 427, 262, 460, 206, 457; 264/312
See application file for complete search history.

(56) References Cited

U.S. PATENT DOCUMENTS

| | | | | |
|---|---|---|---|---|
| 3,192,292 A | | 6/1965 | Banks | |
| 3,746,494 A | * | 7/1973 | Gauger | 425/262 |
| 5,456,590 A | * | 10/1995 | Volmari | 425/427 |
| 6,106,749 A | | 8/2000 | Adly | |

FOREIGN PATENT DOCUMENTS

| | | |
|---|---|---|
| DE | 623624 | 9/1933 |
| GB | 210872 | 2/1924 |
| GB | 430734 | 9/1933 |

* cited by examiner

*Primary Examiner*—Benjamin L. Utech
*Assistant Examiner*—Thu Khanh T. Nguyen
(74) *Attorney, Agent, or Firm*—Patterson, Thuente, Skaar & Christensen, P.A.

(57) ABSTRACT

The invention concerns a procedure for the production of tubes from concrete mix, whereby the concrete mix is filled into a shaping device, for the purpose of shaping, where it is condensed with a tool. The invention should enable an effective and fast production of concrete tubes with high quality regarding the uniformity of the material characteristics. In such a procedure the concrete mix is condensed in an interspace between two parts of a tool that rotate relative to each other.

26 Claims, 5 Drawing Sheets

METHOD AND APPARATUS FOR THE PRODUCTION OF TUBES FROM CONCRETE MIX

FIELD OF THE INVENTION

The invention concerns a method and apparatus for the production of tubes from concrete mix, whereby the concrete mix is filled into a shaping device for the purpose of shaping, where it is condensed with a tool. The invention furthermore concerns arrangements used to carry out the procedure.

BACKGROUND OF THE INVENTION

Vibration procedures are commonly used for the production of tubes from concrete mix to condense the concrete. For that, a vertically standing filling form is used which has walls for shaping the outer and inner contour of the tube. Fresh concrete mix, which is continuously set into vibrations, is poured in the area between these walls. One or more vibrators, most of the time located in the inner space of the filling form, are used to generate the vibrations. Because of the large mass of the tubes to be manufactured, such a vibration system has to be capable to set the total mass of concrete mix and filling form into vibration, which goes along with a high usage of energy. Additionally, a considerable part of the energy is lost, because it is not converted into vibrations in the optimal frequency coverage but in acoustic vibrations causing flexural mode, heat and noise. Such vibration procedures are therefore a noise burden and an expenditure of energy, which connects the production of concrete tubes by this procedure with high cost and health risks.

A further disadvantage of such procedures is, that the quality of the condensation can vary if the vibration device is operating under the constant feed of concrete mix: Since the mixture that was poured in first and is located on the lower end of the form is exposed to the vibrations for a longer period of time than the mixture that is poured in later, the condensation is higher on the lower end, which leads to different material characteristics within the tube.

An improvement regarding the use of energy and uniformity of the material characteristics can be achieved, for example, with the arrangement described in WO 92/18307, which also uses a vibration procedure and consists of inner and outer form-shaping elements that are movable towards each other, but in fact only the inner form-shaping elements can be moved, while the outer element corresponds with a sheathing. The vibrations are generated in a vibration head of an inner form-shaping element and are restricted to a small area along the tube, which in the cause of the concrete feed is shifted along the axis of the tube. To generate the static pressure necessary for the condensation, the upper part of the vibration head has a helical and conical form and the mixture flowing in from above is transported down by rotation and the static pressure is also generated because of the conicity. The condensation itself is then achieved by the vibration.

But the arrangement described in WO 92/18307, which reflects the next phase of technology, has disadvantages as well: Vibrations, whose generation is associated with a high use of energy and noise, is used here for the condensation as well. Additionally, the stress on the material of the form-shaping device is relatively high, since coupled rotation-vibration movements occur in a part of the inner form-shaping element. In other parts rotation only. Due to the construction, the production of the upper end of a tube, which commonly has an acute end contour, is difficult as well. Since the helical vibration head partially stands out from the form towards the end of the fabrication it is questionable, if the static pressure necessary for the condensation corresponds with the one used in the inside of the form, since not enough concrete mixture can be filled in from above. Additionally, it is complicated to remove the inner form-shaping element opposite to the form-shaping device, and during that process possibly clear away material from the inner contour of the tube. It is therefore not suitable for the production of continuous tubes either.

Generally, all vibration procedures and arrangements using such procedures have further disadvantages. Besides noise, which endangers the health of persons that are near the devices that carry out vibration procedures and makes sound insulation measures necessary, the high stress on parts of such devices is an essential disadvantage as well. Additionally, continuous vibration damages are caused by the vibrations, which could lead to crack formation in the sheathing.

Another possibility is the appearance of acceleration differences with areas in which the condensation occurs insufficient due to the construction of the vibration arrangement. This effect is reduced with a vibration device whose linear expansion is shorter than the tube to be produced and that moves relative to the sheathing, but is not completely oppressed. Especially in the areas of the joints is the condensation generally more difficult than in the remaining tube section, zones can even be formed in the joints in which the mixture is considerably less condensed. A further disadvantage is the fact that the natural vibration of the system depends on the filling level of the filling form and that it changes with it. To achieve a proportionate condensation the tuning characteristic of the system is dynamically adapted to the filling level, which requires a very big effort.

Additionally, limits are set for vibration procedures by the procedure itself: Requirement for the usage of this procedure is that the concrete mixture can be condensed sufficiently by vibration. But this requirement is not fulfilled with some mixtures—for example, with mixtures for the production of high-performance or fiber concrete. Furthermore entails the production of thin walled tubes difficulties: In order to not impede the flow of the granular and rather viscous concrete mix that is to be filled in the area between the sheathing, and the vibration core, whose diameter corresponds with the diameter of the produced tube, this area must have a minimum diameter.

A roller head procedure is also used for the production of tubes from concrete mix. In this procedure a rotating pressing tool condenses the concrete mix by pressing it against sheathing. But here as well entails the condensation difficulties in the area of the joints. Furthermore is the bandwidth of processible mixture qualities limited.

DESCRIPTION OF THE INVENTION

Proceeding from this state of technology it is the task of the invention to develop a procedure that allows to produce concrete tubes with low noise and efficiently, with high quality regarding uniformity and stability of the material characteristics of the tube.

According to invention this tasked is solved for a procedure of the previously described kind in such a way, that the concrete mix is condensed in an interspace between two parts of a tool that rotate relative to each other. It is thereby a possibility that only one tool part rotates, or both with different rotational speed in the same cycle direction. But especially effective is this procedure with counter moving rotation.

This not very consuming procedure does not have any vibration and does therefore not have the disadvantages of vibration procedures. Concrete mix is feed to an entry point of the interspace and condensed in the interspace: The granular parts of the concrete mix can roll off each other because of the relative rotation of the tool parts and they can thereby reduce the distance to each other, so that they have a higher component density upon the exit from the interspace. Frictional losses on the rotating tool parts, which represent the dominant part of the energy looses during the condensation, are small and additionally locally limited, since the components of the concrete mix are either granular or liquid. The concrete mix can be brought to its final shape after the exit from the interspace under pressure.

It is thereby practical that the shaping for the outer contour of the tube occurs with a sheathing form and for the inner contour of the tube with the tool that moves relative to the sheathing form at the intended working area sections. This way an effective production is possible, since not further tools have to be used.

Since the concrete mix in the interspace is condensed very high, it also is advantageous to separate the sheathing from the tube immediately after the end of the condensation and shaping. The sheathing form is therefore immediately available for the next production process.

It is to be pointed out here, that tubes with thin walls can also be produced with the procedure according to invention and an arrangement according to invention, since the difficulties of the vibration procedure do not occur here. Especially mixtures with special features, such as high-performance concrete, can be processed as well.

The invention also includes arrangements the production procedure can be carried out with. Such shaping devices consist of a sheathing form to shape the outer contour of the tube and a multipart tool connected to at least one drive device for the condensation of the of the concrete mix filled in the shaping device and to form the inner contour. A first and a second part of the tool are thereby driven rotating relative to each other. Thereby, only one part of the tool can rotate, or both parts synchronized with the same or different rotational speed, or both parts countermoving with the same or different rotational speed. Between a first work area section of the first part of the tool and a second work area section of the second part of the tool is an interspace for the transfer and condensation the concrete mix. To shape the inner contour, a second work area section of the first part of the tool also has a first outer cylinder with the axis of rotation of the first part of the tool as symmetry axis. The diameter of the first outer cylinder is selected corresponding to the inner diameter of the tube to be produced. By way of the rotation of the first part of the tool the concrete mix is put in its final form and smoothed at the same time after the condensation and exit from the interspace.

Thereby it is practical for the size of the interspace, meaning the minimal distance of the work area sections rotating relative to each other, in regards to an effective condensation to select a value that lies in the area of the medium size grain of the grains of the concrete mix. It proofed to be especially effective to use a value of approximately double the medium diameter of the largest grains of the concrete mix.

To achieve the countermoving rotation of two tools, rotating around the same axis, it is practical to drive both parts of the tool by special shafts. Thereby, it is preferred that the first part of the tool is driven by a shaft and the second part of the tool by a hollow-shaft that surrounds the shaft. This has the advantage that both parts can be driven by a joint drive device, or by two drive devices that are easy accessible and space saving mounted adjacent to each other along the axis of rotation. But imaginable are also two shafts with two drive devices on the opposite sides of the tool.

In an advantageous variation of the invention tool and sheathing form are positioned movable against each other. Thereby, a guide for the tool to achieve a relative motion is intended as well. So can, for example, the sheathing form be rigidly fastened and the tool with the help of the guide under the feeding of concrete be moved from one end of the form to the other. According to this, the concrete mix is first off all condensed at one end first, shaped in the final form and smoothed. The tool can thereby be moved relative to the sheathing form along the axis of rotation until the other end is reached and then be removed there. A continuous concrete feed, rotation and relative motion along the axis of rotation is therefore essential for a particularly uniformed condensation and shaping, meaning high uniformity of the material characteristics. Another possible variation could also be the fastening of the tool and a moving filling form. A production of continuous tubes is included herein as well.

Advantageous with such shaping devices are the two work area sections of the two tool parts, between which the interspace for the transfer and condensation of the concrete mix is located, conical shaped, whereby the symmetry axis of a taper joins the axis of rotation of the respective tool and the symmetry axis of the tube. Thereby one will not select a complete taper as work area section at the time, but each time only one segment, which corresponds with a cut vertical to the symmetry axis, since this way other work area sections with other functionality remain available. Because of the conical form the interspace has only one opening, which is oriented to the axis of rotation, and another opening, which is oriented in the direction of the outer area between tool and sheathing form, which simplifies the control of the concrete flow.

In an advantageous variation the first work area section of the first part of the tool has the shape of a first outer taper, which becomes narrower in the direction from which the concrete mix is fed. The second work area section of the first part of the tool, which has the form of a first outer cylinder, can then, for example, be connected in the opposite direction. Furthermore, it is advantageous regarding the above-mentioned variation, if the first work area section of the second part of the tool has the shape of an inner taper, which also becomes narrower in the direction the concrete mix is fed from. The concrete mix is therefore guided into the opening of the interspace that is oriented in the direction of the axis of rotation. At the conical contact surface of the interspace the granular parts of the concrete mix roll off each other and are condensed. After that, because of the pressure of the incoming mixture, they exit in the room between the tool and the sheathing form through the opening that is oriented in direction of the sheathing form.

To achieve an effective condensation, it is advantageous that inner and first outer tapers include the same taper angle—the acute angle that is formed by the cross-section of a taper with a plane vertical to the symmetry axis—or that the taper angle of the inner taper is wider than the taper angle of the first outer taper by maximal 15%, whereby the taper angle of the first outer taper is preferably in the area of 50° to 75°. Too wide of a taper angle requires a much extended tool along the axis of rotation, which is impractical due to production technology reasons; too flat taper angles at small tube diameters do not allow an effective condensation. If the taper angle of the inner taper is wider than the one of the outer taper, the interspace becomes narrower in direction of the flow, which increases the condensation of the mixture and additionally an increased pressure is built up under which the mixture parts exit from the narrower end of the interspace into the space between sheathing form and tool.

If the taper angles from the inner and first outer taper are selected equal, a taper angle of 65° is especially suited in respect to the production. To increase the condensation in case of equal taper angles and also to improve the mixture transfer through the interspace it is advantageous to void a recess that is spiral shaped around the axis of rotation on the first outer taper. This spiral shaped recess eases the transfer of the mixture through the interspace.

The spiral shaped recess on the first outer taper can have a variety of shapes, but it is advantageous if it has the contours of sectors in the cross-section along the axis of rotation. Circular contours have the advantage that they don't have any inner edges in which the material could easily get stuck. They are also easier to produce, which has an advantageous effect on the production cost of the tool. Thereby, the edges between conical area and recess can also be flattened tub-edge shaped. In the most simple and easiest to realize variation the circles, which determine the contours of the spiral shaped recess on the first outer taper, all have the same radius. It is also practical to select the center of these circles positioned on a taper, which creates another possibility of control of the condensation, if one selects the taper angle of this taper advantageously equal to or smaller than the taper angle of the first outer taper. If this taper has the same taper angle as the first outer taper, the material is guided through the interspace and is essentially condensed only by the roll off each other. But if this taper has a slightly smaller taper angle as the first outer taper, preferably 60°, the sectors will turn out flatter towards the blunt end of the first outer taper, which increases the condensation and also builds up a higher pressure than with the same taper angle, with which the mixture is finally pressed out of the interspace in the area between the sheathing form and tool.

In another practical variation of the invention a second work area sector of the second part of the tool has the shape of a second outer taper, which symmetry axis corresponds with the axis of rotation of the second part of the tool and which narrows in the direction from where the concrete mix is fed. Since a lot of tubes, for the purpose of the possibility to interlock, have on one side an end with a larger outside diameter and on the other side an end with an outside diameter which—at equal inside diameters—is smaller than the outside diameter of the tube in the remaining area, the sheathing form narrows in this direction and often ends with an acute end form, whereby the concrete mix is fed most of the time from the direction of the acute end form. If now the tool is moved in the direction of the acute end form the available area between tool and sheathing from becomes smaller. At the same time the condensed concrete mix flows over the opening, through which it exits from the interspace, to the top as well since it exits under pressure. Therefore, the effect of stronger forces on the tool by backed-up concrete mix during shaping in the area of the acute end form is avoided due to the conical shape of the second work area sector of the second part of the tool. This works especially effective in the area of taper angles between 65° and 83°, preferably at a taper angle of 77°.

It is advantageous in this case if a recess, which is spiral shaped around the axis of rotation, is voided on the second outer taper. Through this, if the area of the acute end form is reached and the concrete mix almost fills this hollow space, the concrete mix is transported from the acute end of the form in direction of the first part of the tool, and the tool can be removed from the sheathing form without problem. It is advantageous here as well, that the spiral shaped recess has the contours of sectors in the cross-section along the axis of rotation, whereby the contour determining circles in the most simple and easiest to realize variation all have the same radius. For practical purposes the spiral shaped recess on the second outer taper is designed in such a way that the centers of the circles, which determine their contour, are positioned on a taper. It is thereby advantageous for an even transport of the already condensed mixture if the taper angle of this taper has the same or a—with a difference in the value of about up to 5 degrees—similar taper angle as the second outer taper, preferably 78°.

To get the concrete mix in the interspace for the feed-through and condensation of the concrete mix, the second part of the tool is, for practical purposes, equipped with openings on the side that faces the direction from which the concrete is fed. These openings serve for the transportation of the concrete mix into the interspace. In principle, one are more large openings are sufficient.

But to avoid that possibly clumpy concrete mix flows along with only a part of the tool in its direction of rotation and thereby perhaps closes the interspace, a design of the openings as slits, which are essentially positioned parallel to the axis of rotation of the second part of the tool, is advantageous. This way the concrete mix can effectively be prevented to circulate in only one direction of rotation and clumpy mixture parts are can be pulled apart until they break up.

Finally, it is advantageous, if also a third work area section of the second part of the tool has the shape of a second outer cylinder around the axis of rotation of the second part of the tool to shape the inner contour, whereby the second outer cylinder has the same radius as or a larger radius as the first outer cylinder. At the same radius, the second outer cylinder can be used for pre-shaping and relief the first outer cylinder. To facilitate the removal of the tool, it is advantageous to continue the spiral shaped recess on the second outer taper in the third work area sector.

If the radius of the second outer cylinder is selected larger than the one of the first outer cylinder it is in principal possible to produce a concrete tube of two layers, whereby the outside layer is shaped and condensed by the second outer cylinder only. A roller plane with tool parts that work according to the principle of the roller head procedure could therefore be intended here to increase the condensation effect. Possible is also the use of a third part of the tool for condensation of the components of the concrete mix for the outside layer between the second and third part of the tool in the above described way. The component of the mixture for the inside layer is highly condensed in the interspace between the first and second part of the tool and brought into final shape by the first outer cylinder.

BRIEF DESCRIPTION OF THE DRAWINGS

The invention is to be described in the following with the help of an example. The accompanying drawings show.

DETAILED DESCRIPTION OF THE DRAWINGS

Figure 1:
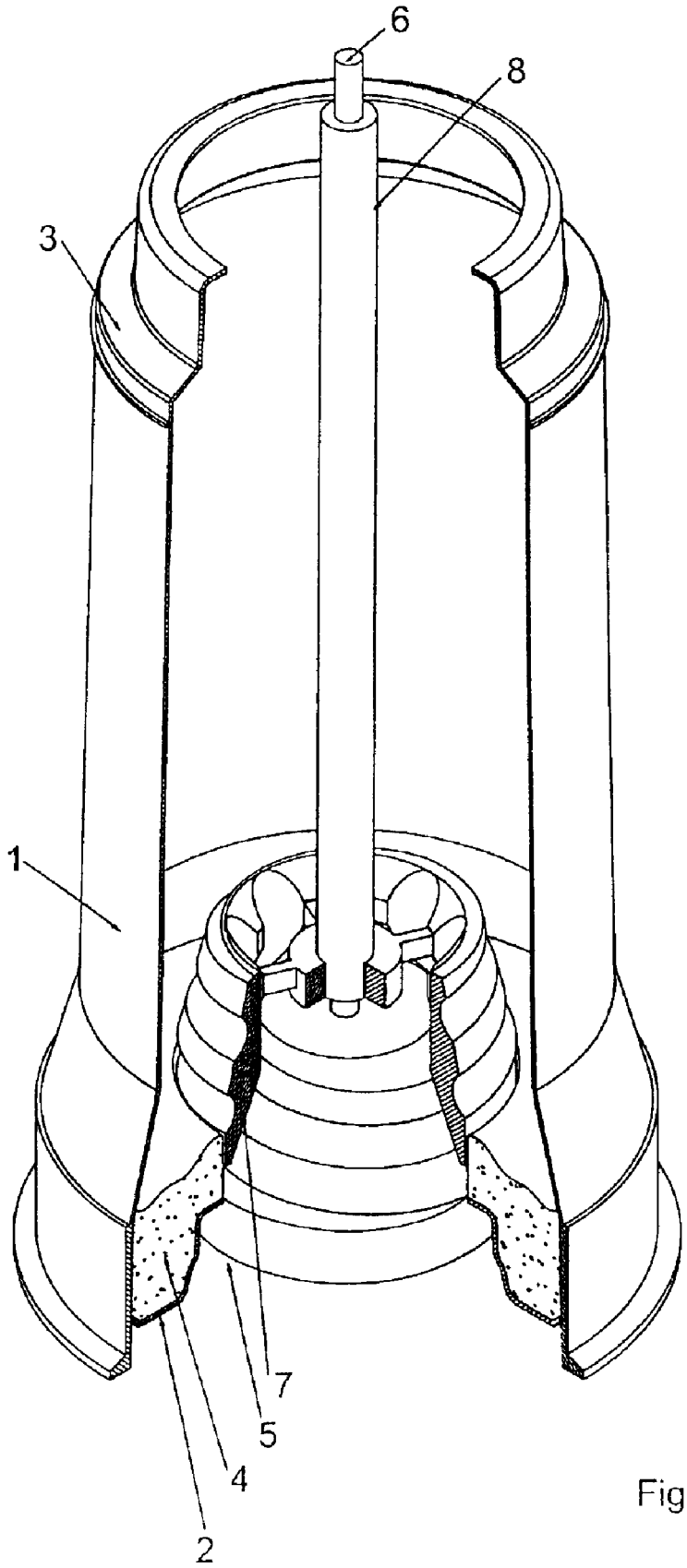
FIG. 1 a total view of a shaping device.

FIG. 1 illustrates the total view of a shaping device according to invention, which is suitable for the execution of the procedure according to invention. A sheathing form for the shaping of the outer contour consists of a sheathing 1, which is equipped with a lower joint 2 and an upper joint 3. Lower joint 2 and upper joint 3 furthermore serve the purpose of producing fitting tubes that can be connected with each other, the upper joint 3 gives the sheathing form the shape of a pointed and. In the sheathing form, in the area of the lower joint 2, is the concrete mix 4. The first part 5 of the tool, which is driven by a shaft 6, is located in the drawing still outside the sheathing form while the second part 7 of the tool, which is driven by a hollow shaft 8, is at the pre-shaping of the concrete mix 4 already.

Figure 2:
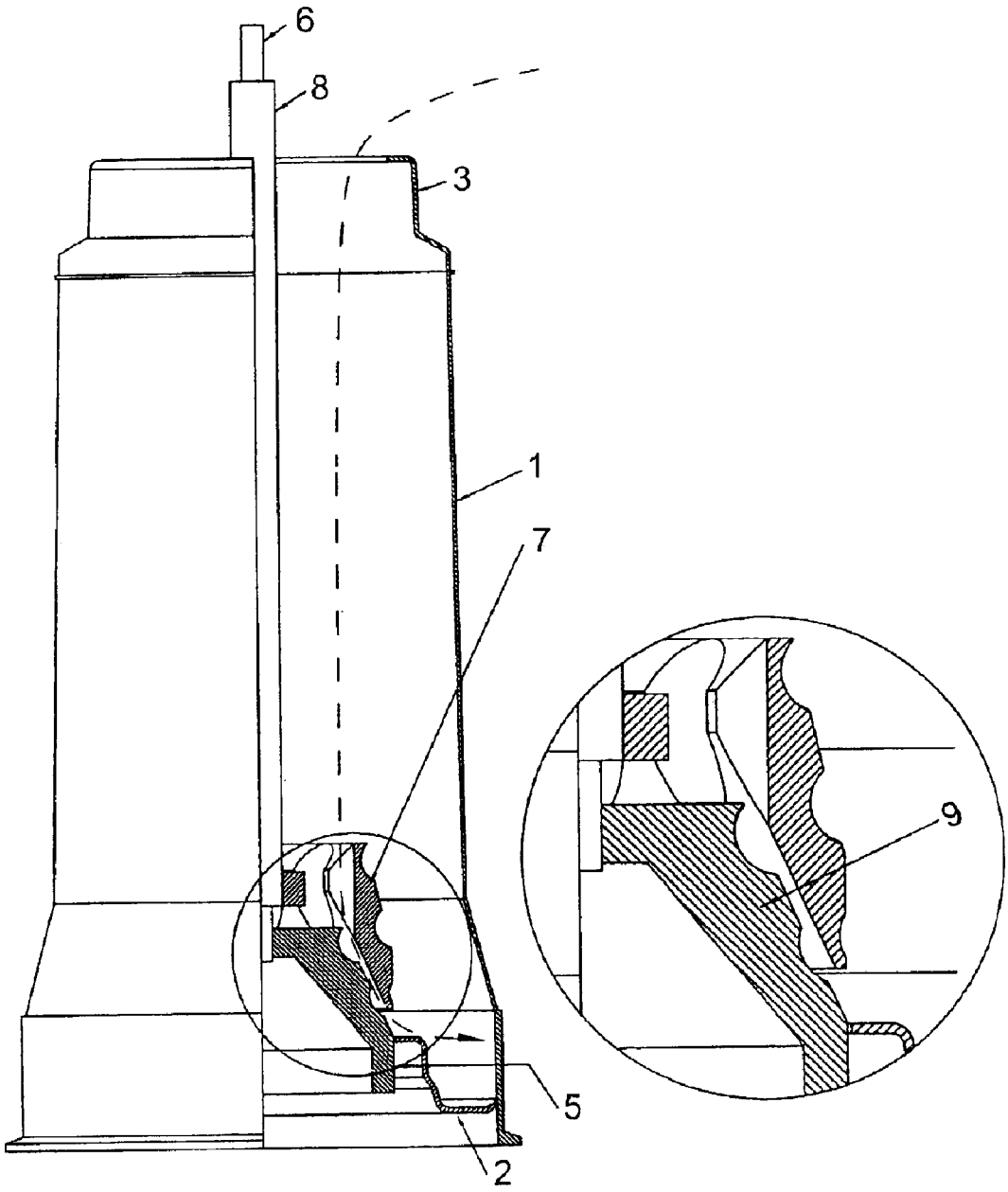
FIG. 2 a cross-section through the shaping device with an enlarged illustration of the interspace area, FIG. 3 a mount with guide for the tool for the achievement of a relative motion, FIG. 4 an illustration of the first part of the tool, and FIG. 5 an illustration of the second part of the tool.

FIG. 2 illustrates a partial cross-section through the shaping device. In the shown arrangement the first part 7 of the tool is positioned over the first part 5 of the tool in the direction from where the concrete is fed and surrounds it partially. Between them is the interspace 9 for the transfer and condensation of the concrete mix. The first part 5 of the tool and the second part 7 of the tool can be set into rotation, independently from each other, with the shaft 6 and the hollow shaft 8. The path the concrete mix 4 takes is drawn in as a dashed line. Filling is done from above, caught by the second part 7 of the tool and transferred into the interspace 9 where it is condensed by the roll-off of the granular part of the concrete mix 4 from each other. It exists after the condensation at the lower end of the interspace 9, radial and under pressure, into the area between sheathing form and tool, where the shaping of the inner contour by the first part 5 of the tool occurs. The concrete mix 4 is pressed in the area between sheathing form and tool until this area is filled and the concrete mix 4 starts to move upwards through the opening of the interspace 9.

Figure 3:
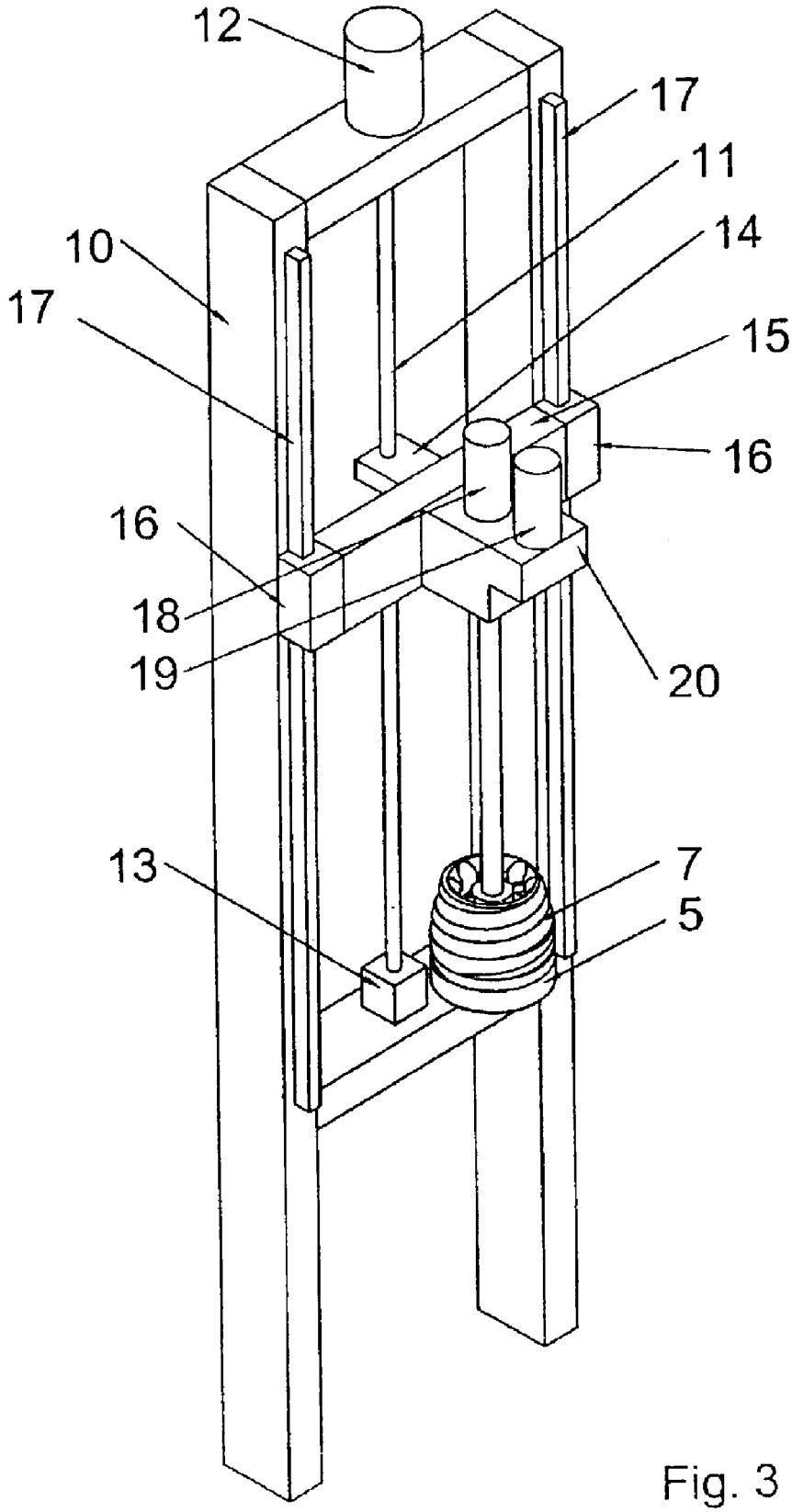

With the help of the mount 10, as it is illustrated in FIG. 3 as an example, the tool can then slowly be moved relative to the sheathing form along the axis of rotation in the direction of the upper joint 3, by which the complete inner contour is shaped. For that a guide is intended in this example: a spindle 11, which is driven on one side by a drive device 12 and settled on the other side in a bearing 13, is connected through a spindle nut 14 with a crossbar 15 that has runners 16 at its ends. Guide rails 17 along the direction of the spindle guide the runners 16. The crossbar 15 itself is connected through a gear 20 with a drive device 18 for the shaft drive and a drive device 19 for the hollow shaft drive.

Figure 4:
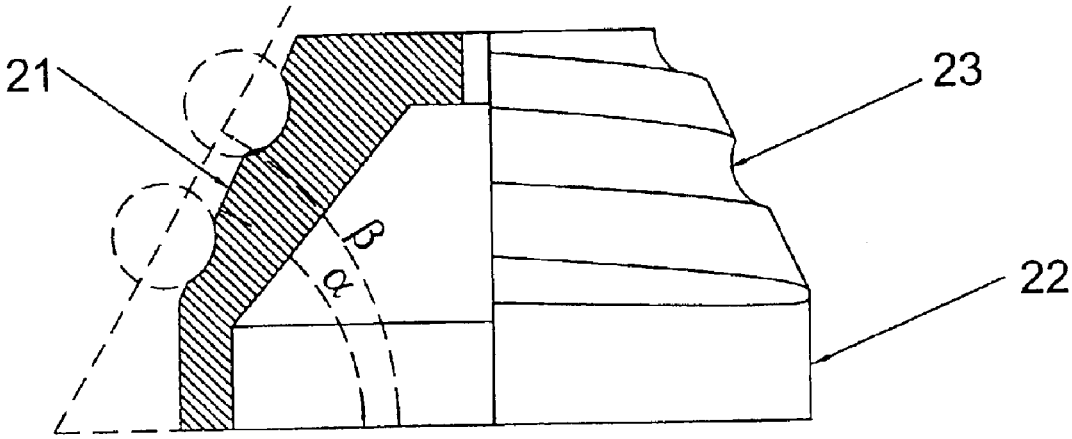
Figure 4:
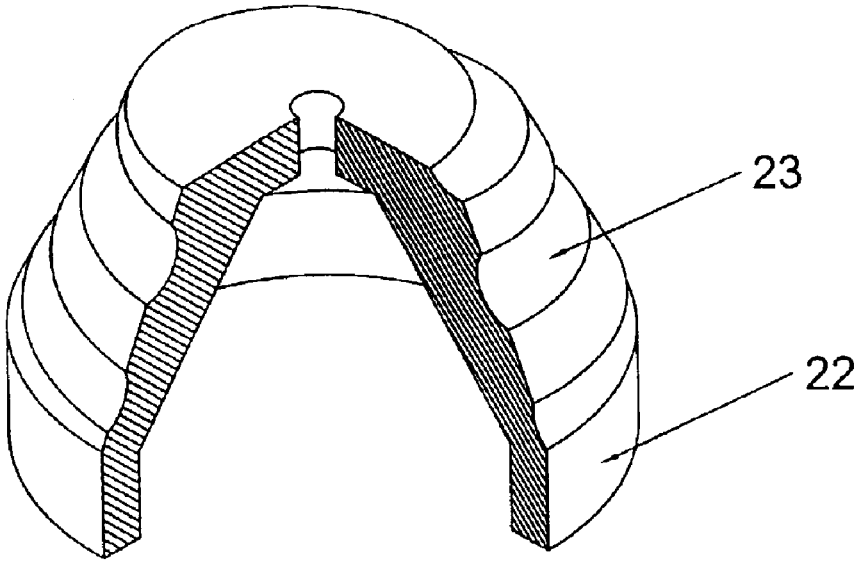

FIG. 4 shows different views of the first part 5 of the tool with conical form. The first work area section of this tool part has the shape of a first outer taper 21, the second work area section the shape of a first outer cylinder 22. The first outer cylinder 22 is smooth and serves the shaping of the inner tube contour. A recess 23, which spiral shaped around the axis of rotation, is voided on the first outer taper 21. It serves the control of the mixture transfer through the interspace 9: In the upper area collected concrete mix 4 is transferred down and condensed at the same time. The spiral shaped recess 23 has in the cross-section the contours of sectors to avoid that concrete parts remain in corners or inner edges. The centers of the circles are positioned on a conical area, whose taper angel $\beta$ is slightly smaller than the taper angle a of the first outer taper 21, by which the condensation can be increased. The pressure under which the concrete mix 4 exists through the interspace 9 into the area between tool and sheathing can be increased as well.

Figure 5:
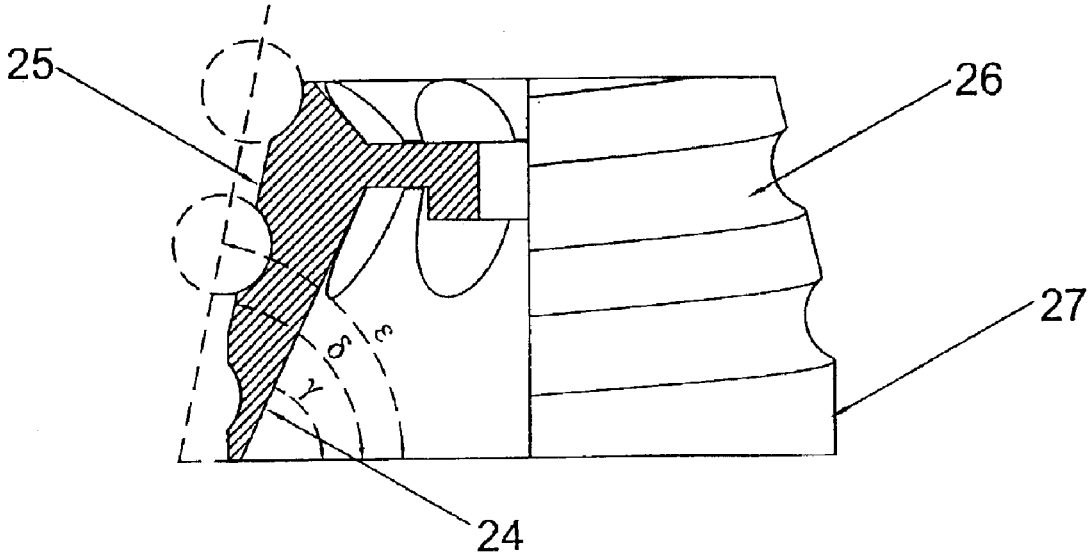
Figure 5:
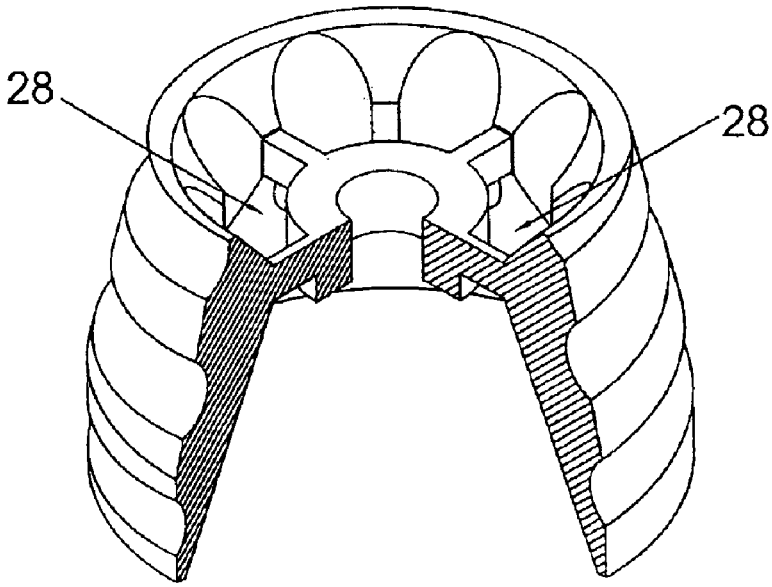

FIG. 5 shows different views of the second part 7 of the tool. The first work area section of this part has the shape of an inner taper 24. The taper angle $\gamma$ of the inner taper 24 and the taper angle a of the first outer angle 21 are the same. The second work area section of this section has the shape of a second outer taper 25. A spiral shaped recess 26, whose screw-direction is opposite to the spiral shaped recess 23, is voided on the second outer taper 25.

The fed concrete mix 4 is transported through the spiral shaped recess 26 from the pointed end of the sheathing form with the upper joint 3 in direction of the first part 5 of the tool. This allows an easier removal of the tool from the sheathing form. The spiral formed recess 26 has the contours of sectors in cross-section to prevent that mixture parts remain in corners or inner edges. The centers of the circles are positioned on a conical area, whose taper angel $\epsilon$ is slightly wider than the taper angle $\delta$ of the second outer taper 25. The side of the second part 7 of the tool that points in the direction the concrete mix 4 is fed from has openings 28 through which the concrete mix 4 is transported into the interspace 9. The slit like shape prevents a circulating of the uncondensed concrete mix 4 with the direction of rotation of the first part 5 of the tool. A third work area section of the second part 7 of the tool has the shape of a second outer cylinder 27, which can be used for the pre-shaping of the concrete mix 4, when it moves upwards through the opening of the interspace 9 to the sheathing form. In this case, the spiral shaped recess 25 extends over this second outer cylinder 27 as well, which has no effect on the final shaping and should only make the removal of the tool easier.

Another imaginable possibility of use for the procedure and arrangement, which results from the claims, is the production of two-layered concrete tubes. This is meaningful, for example, if requirements are made on the inner contour of the tube which make it necessary to use high-quality and expansive concrete for the inner layer. These requirements are not made for the outside area so that, in principal, different concrete can be used for the outer layer. With the illustrated arrangement it is also possible to process a concrete mix of two components, whereby each of them can be concrete mix with different components as well, without essential mix of the components, if the second part 7 of the tool is designed in such a way, that the radius of the second outer cylinder 27 is larger than the radius of the first outer cylinder 22. The difference of the two radiuses then determines the wall thickness of the inner layer. The concrete mix intended for the outer layer is then guided directly into the space between the sheathing form and the tool, where it is smoothed and condensed by the second outer cylinder 27. A roller surface with tool parts, which work according to the principal of the roller head procedure, can therefore be intended on the second outer taper 25 to increase the condensation effect of the second part 7 of the tool.

The high-quality concrete mix intended for the inner layer is the only one of the two mixtures that is guided through the openings 28 into the interspace 9 where it is condensed. The final shaping of the inner diameter is carried out by the outer cylinder 22. It naturally has to be observed, that the paths of the concrete mix are separated for the inner and outer layer. This can be done, for example, with a hollow cylinder that surrounds the hollow shaft 8, whereby the hollow cylinder should have about the same diameter as the second part 7 of the tool on the side that corresponds with the direction the concrete mix is fed from.

What is claimed is:

1. A shaping device for the production of tubes from concrete mix, comprising:

a sheathing form to shape an outer contour of a tube; and a multipart tool connected with at least one drive device for condensation of the concrete mix that is filled in the shaping device, for the shaping of an inner contour of the tube, the multipart tool including a first part of the tool and a second part of the tool rotationally driven countermoving to each other, whereby an interspace for the transfer and condensation of the concrete mix exists between a first work area section of the first part of the tool and a first work area section of the second part of the tool, a second work area section of the first part of the tool having the shape of a first outer cylinder around the axis of rotation of the first part of the tool for the shaping of the inner contour.

2. The device of claim 1, wherein the size of the interspace is defined in such a way that the smallest distance between the first work area section of the first part of the tool and the first work area section of the second part of the tool corresponds with approximately two times the medium diameter of the largest grains of the concrete mix.

3. The device of claim 1, wherein the first and second parts of the tool are driven by separate shafts, the first part of the tool by a shaft and the second part of the tool by a hollow shaft that surrounds the shaft.

4. The device of claim 1, wherein the tool and the sheathing form are positioned movable against each other, the tool further including a guide for achieving a relative motion.

5. The device of claim 1, wherein the two work area sections of the tool have the interspace for the transfer and condensation of the concrete mix between them in conical form with the axis of rotation of the respective parts of the tool along a symmetrical axis for a taper.

6. The device of claim 5, wherein the first work area section of the first part of the tool has the shape of a first outer taper which narrows in the direction from where the concrete mix is fed.

7. The device of claim 6, wherein the first work area section of the second part of the tool has the shape of an inner taper which narrows in the direction from where the concrete mix is fed.

8. The device of claim 7, wherein a taper angle ($\gamma$) of the inner taper is equal or up to approximately 15° wider than a taper angle (a) of the first outer taper, whereby the taper angle (a) of the first outer taper is in the range of approximately 50° to 75°.

9. The device of claim 8, wherein the taper angle (a) of the outer taper and the taper angle ($\gamma$) of the inner taper are approximately 65°.

10. The device of claim 6, including a recess which is spiral shaped around the axis of rotation and is voided on the first outer taper.

11. The device of claim 10, wherein the spiral shaped recess on the first outer taper has a circular cross-section.

12. The device of claim 11, wherein circles which determine the circular cross-section recess on the first outer taper each have the same radius.

13. The device of claim 12, wherein the centers of the circles which determine the circular cross-section formed recess on the first outer taper are positioned on a conical surface.

14. The device of claim 13, wherein the conical surface on which the centers of the circles are positioned have a taper angle ($\beta$) which is equal or smaller than a taper angle (a) of the first outer taper of approximately 60°.

15. The device of claim 1, wherein the second work area section of the second part of the tool has the shape of a second outer taper having a symmetrical axis corresponding with the axis of rotation of the second part of the tool and which narrows in the direction from where the concrete mix is fed.

16. The device of claim 15, wherein a taper angle ($\delta$) of the second outer taper is equal to or wider than a taper angle ($\gamma$) of an inner taper of the first work area section of the second part of the tool, with the taper angle ($\delta$) being in the range of approximately 65° to 83°.

17. The device of claim 16, including a recess which is spiral shaped around the axis of rotation, and is voided on the second outer taper.

18. The device of claim 17, wherein the spiral shaped recess on the second outer taper has a circular cross-section.

19. The device of claim 17, wherein the circles which determine the circular cross-section formed recess on the second outer taper each have the same radius.

20. The device of claim 18, wherein the centers of the circles which determine the circular cross-section formed recess on the second outer taper are positioned on a conical surface.

21. The device of claim 20, wherein the conical surface on which the centers of the circles are positioned have a taper angle ($\epsilon$) which is equal or smaller than the taper angle ($\delta$) of the second outer taper.

22. The device of claim 1, wherein the second part of the tool has openings on a side that faces where the concrete mix is fed for the transfer of the concrete mix into the interspace.

23. The device of claim 22, wherein the openings are designed as slits which are substantially positioned parallel to the axis of rotation of the second part of the tool.

24. The device of claim 1, including a third work area section of the second part of the tool, for the purpose of shaping the inner contour, having the shape of a second outer cylinder around the axis of rotation of the second part of the tool, with an equal or larger radius as the first outer cylinder.

25. The device of claim 24, wherein the second outer cylinder has a continuation of a spiral shaped recess on a second outer taper.

26. The device of claim 24, wherein the radius of the first outer cylinder is smaller than the radius of the second outer cylinder, wherein a device for the separated feeding of two components of the concrete mix is intended so that only one of the components is guided into the interspace, while the other component is directly guided into the space between the sheathing form and the tool.

* * * * *

UNITED STATES PATENT AND TRADEMARK OFFICE

CERTIFICATE OF CORRECTION

PATENT NO. : 6,984,118 B2
APPLICATION NO. : 10/286337
DATED : January 10, 2006
INVENTOR(S) : Helmut Kuch et al.

It is certified that error appears in the above-identified patent and that said Letters Patent is hereby corrected as shown below:

Column 7,
Line 13, delete “and” and insert -- end --.
Line 65, delete “angel” and insert -- angle --.
Line 66, delete “a” and insert -- $\alpha$ --.

Column 8,
Line 6, delete “a” and insert -- $\alpha$ --.
Line 18, delete “angel” and insert -- angle --.

Signed and Sealed this

Twentieth Day of June, 2006

JON W. DUDAS
*Director of the United States Patent and Trademark Office*